United States Patent [19]

Barton

[11] 4,408,406

[45] Oct. 11, 1983

[54] LUGGAGE IDENTIFICATION TAG

[76] Inventor: C. D. Barton, 815 W. 53rd Ter., Kansas City, Mo. 64112

[21] Appl. No.: 303,919

[22] Filed: Sep. 21, 1981

Related U.S. Application Data

[63] Continuation-in-part of Ser. No. 268,583, May 29, 1981, abandoned.

[51] Int. Cl.[3] ..... G09F 3/18

[52] U.S. Cl. ..... 40/19; 40/21 C

[58] Field of Search ..... 40/21 C, 19, 10 D, 2 A, 40/300, 488

[56] References Cited

U.S. PATENT DOCUMENTS

| | | | |
|---|---|---|---|
| 1,211,681 | 1/1917 | Currie | 40/19 |
| 2,677,901 | 5/1954 | Tilleman | 40/19 |
| 2,829,453 | 4/1958 | Mattes | 40/21 C |
| 2,850,819 | 9/1958 | Payne | 40/300 |
| 4,031,859 | 6/1977 | Stewart | 40/21 C |
| 4,232,128 | 2/1981 | Kane | 40/21 C |

*Primary Examiner*—Gene Mancene
*Assistant Examiner*—Wenceslao J. Contrera
*Attorney, Agent, or Firm*—Kokjer, Kircher, Bradley, Wharton, Bowman & Johnson

[57] ABSTRACT

A luggage identification tag includes a rigid tube to which an address label is applied and a transparent outer tube covering the label. A nylon strap extends loosely through the inside tube and can be looped through the handle or other part of a luggage item and secured by a buckle. The tube is thus supported at both ends and can freely rotate and slide on the strap to avoid snagging on obstructions. An opaque band half as wide as the tube is long slides along the outer transparent tube and serves to cover part of the label to prevent it from being read at a glance. In a modified form of the invention, a band on the outer tube covers the entire label except for a narrow window which exposes a single line of the label at a time.

8 Claims, 7 Drawing Figures

LUGGAGE IDENTIFICATION TAG

BACKGROUND OF THE INVENTION

This application is a continuation-in-part of my earlier application Ser. No. 268,583, filed May 29, 1981 and now abandoned.

This invention relates to an improved identification tag for luggage.

The most commonly used luggage identification tags are the type having a flat holder which contains a card or label on which identification information is entered. A beaded chain or leather strap is passed through a hole in the card holder and is extended through the handle of the suitcase or other luggage article to attach the identification tag to the luggage. The primary problem with luggage tags of this type is that they are highly susceptible to being torn away from the luggage.

Modern airline terminals and other transportation facilities have automated baggage handling equipment such as conveyor systems which transport luggage between various locations. Suitcases and similar bags typically travel along the conveyor on their sides, and the chain or strap which attaches the luggage tag to the luggage handle is so long that the tag hangs down below the luggage. As a result, the tag often catches on rollers and other conveyor components. The manner in which existing identification tags are constructed and attached to the luggage also results in frequent entanglement of the tag with other baggage items, with diverter arms and other parts of the baggage handling equipment, and with other obstructions. The extent to which the luggage tag hangs away from the bag and tends to flap around is increased since it is normally attached to the suitcase handle which itself hangs relatively loosely from the bag. Also, the sharp corners presented by flat rectangular card holders increase their susceptibility to snagging.

The relatively weak beaded chains and leather straps that are typically used to attach the identification tag to the luggage article are easily broken when the bag becomes caught on an obstruction. The chain or strap ordinarily passes through a single hole or grommet located near one edge of the card holder, and the intervening material is easily torn or broken away even if the chain or strap does not break. The overall result is that snagging of the luggage tag nearly always causes its loss and/or destruction. Thus, a large number of tags are lost annually by a large percentage of the travelling public, and the lost tags are disposed of by the airlines and others.

Another problem with existing luggage tags is that the name and address of the owner and other identification information on the identification card is clearly exposed. Thus, burglars can easily note at a glance the addresses of travelers on outbound flights in order to obtain the locations of potentially uninhabited residences for possible burglary. Existing tags are also unsightly for the most part and can be annoying when they flap against the hand or wrist of the person carrying the luggage.

SUMMARY OF THE INVENTION

The present invention is aimed at eliminating or reducing these problems and has, as its primary goal, the provision of a luggage identification tag which is not susceptible to catching or snagging on obstructions.

More specifically, it is an object of the invention to provide an improved luggage tag having a rigid tube containing identification information thereon and a connecting strap which passes freely through the tube to support it at both ends. The three dimensional tube by its very nature and shape prevents the identification label from being completely exposed from any one vantage point and is to be contrasted with flat card holders which permit easy glance reading of the identification information. Supporting the tube at both ends prevents it from hanging down below the bag and thus greatly reduces the tendency of the tag to snag on obstructions or become entangled with automatic baggage handling equipment. Also, the tube can freely slide along and rotate on the strap to even further reduce the possibility of snagging, and its smoothly curved outer surface does not readily become entangled with obstructions.

Another object of the invention is to provide a luggage identification tag which is constructed in a manner to resist being torn away from the luggage even if snagging should occur. Again, the extension of the strap completely through the tube is significant in that it avoids the problems associated with passing straps through holes or grommets in flat card holders. Furthermore, the strong nylon strap is not easily broken and the strength of the tube is much greater than that of a flat member.

It is an additional feature of importance that the information on the address label cannot be read at a glance. As previously indicated, the identification information on the label extends around the curved surface of the tube so that the three dimensional nature of the tube is sufficient by itself to prevent the address information from being completely exposed from any one vantage point. As a further security precaution, on embodiment of the unit has a sliding opaque band which covers nearly one half of the address label at all times to hide the identification information from potential burglars. Authorized airline personnel can read the label when necessary by sliding the band first to one end and then to the other end. An alternative embodiment has a band which covers the entire address label except for a thin window which is only large enough to expose a single line of the identification information at a time. By rotating the band, the address label can be read on line at a time by authorized persons.

Yet another benefit that results from the tubular or cylindrical shape of the unit is that a larger address label can be employed than is possible with the flat luggage tags of similar overall size. Additional identification information can thus be provided on the label.

A still further object of the invention is to provide a luggage identification tag that is compact, simple and economical to construct, easy to assemble, and well suited for use with a wide variety of luggage items of varying sizes.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
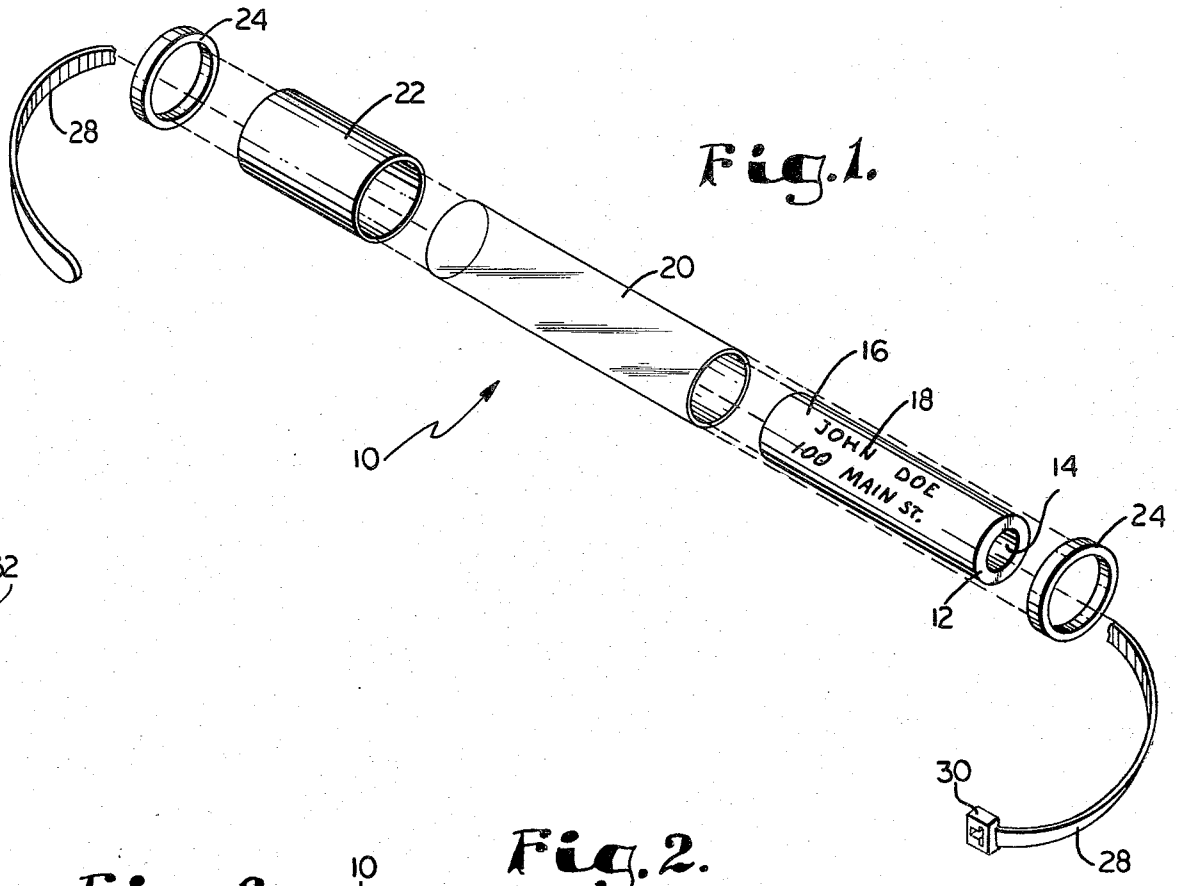
FIG. 1 is an exploded perspective view of a luggage identification tag constructed according to a first embodiment of the present invention, with the central portion of the connecting strap broken away for illustrative purposes.
Figure 2:
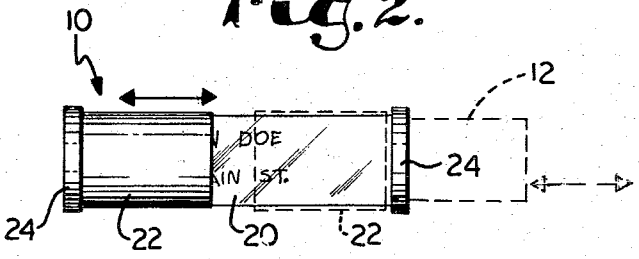
FIG. 2 is an elevational view of the luggage identification tag in its assembled form, with the broken lines indicating an alternative position of the opaque band and removal of the inside tube.
Figure 3:
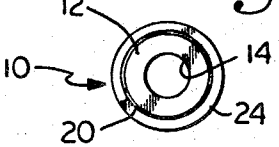
FIG. 3 is an end elevational view of the luggage identification tag.
Figure 4:
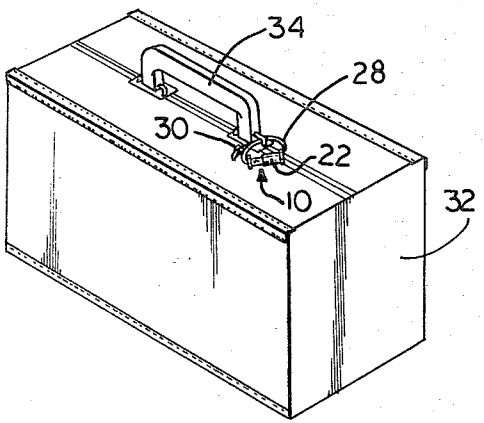
FIG. 4 is a perspective view showing the luggage identification tag attached to the handle of a luggage item.

Referring now to the drawing in more detail, and initially to FIGS. 1–4, numeral 10 generally designates a luggage identification tag constructed in accordance with one embodiment of the present invention. The identification tag 10 has a generally cylindrical shape and includes a rigid tube 12 which is preferably constructed of a tough plastic substance such as polyvinyl chloride. Tube 12 has a cylindrical passage 14 extending longitudinally through it between the opposite ends of the tube. By way of example, the inside diameter of tube 12 can be approximately 0.25 inch and its outer diameter can be approximately 0.54 inch. It is to be understood that these dimensions can vary substantially, and that tube 12 can be constructed of any suitable material.

The outside surface of tube 12 is cylindrical and receives a thin flexible label 16. The label may be paper or any other material on which identification information 18 can be printed or typed. Normally, the identification information 18 includes the name, address and phone number of the owner of the luggage item. The label 16 is initially flat and is sized such that it can be applied to the cylindrical outside surface of tube 12 to extend completely around the surface with the ends of the label slightly overlapping one another. The side of label 16 opposite the side on which the identification information is entered is an adhesive side which is initially covered by a paper backing (not shown). After the identification information has been entered, the paper backing is removed and the adhesive side of the label is applied to tube 12 in order to secure the label to the tube. The adhesive attachment of the label assures that it is adequately controlled during insertion and maintained properly in position on the tube.

The cylindrical shape of the surface which receives label 16 permits a relatively large label to be used and thus permits a large amount of identification information to be entered on the label. The identification information 18 is preferably entered such that it extends completely around the outside surface of tube 12. Thus, the complete address of the owner of the luggage item is not visible from any one vantage point, as will be explained more fully.

The address label 16 is covered by a transparent outer tube 20 which is large enough to closely receive tube 12 with the label 16 applied thereto. Tube 20 may be formed of a material such as cellulose acetate butyrate and preferably has an inside diameter of approximately 9/16 inch in order to closely receive tube 12 and label 16. Since tube 20 is transparent, the identification information 18 which is entered on label 16 is readily visible through the outer tube. Tube 20 is the same length as the inside tube 12 and protects the label 16 from the weather and from dirt and other foreign matter.

An opaque band 22 is received on tube 24 for longitudinal sliding movement thereon. The length of band 22 is slightly less than half of the length of tube 20 such that band 22 covers approximately half of the identification information 18 at any one time. Band 22 can slide the entire length of tube 20 between the positions shown in solid lines and broken lines in FIG. 2. It is contemplated that band 22 will normally be approximately centered on tube 20 to best cover the address information of label 16.

Band 22 may be formed of any suitable material, and in the preferred form of the invention, it is constructed of a tough plastic material which is commercially available under the trademark "LEXAN." Promotional and advertising material can be applied to band 22, as by silk screening or any other suitable process. In applying band 22 to tube 20, the hand is wrapped around the tube with a wire (not shown) interposed between the two members. The ends of band 22 are then overlapped, and adhesive is applied to hold the overlapped ends together prior to removing the wire. The use of a wire assures that band 22 will be loose enough to readily slide on tube 22 while being tight enough to remain in the position to which it is moved.

A pair of relatively soft rings 24 are mounted on the exterior surface of tube 20 at its opposite ends. Rings 24 are initially smaller than the outer diameter of tube 20 and are stretched onto the tube in order to maintain them in the proper positions thereon. Additionally, rings 24 are glued in place on tube 20 by a very strong, fast setting glue. The rings 24 provide decorative trim for the unit and also act as stops which prevent the sliding band 22 from being removed from the ends of tube 20. The rings also serve as bumpers which provide padding on the ends of the unit and protect the thin ends of the outer tube 20.

An elongate strap 28 is used to attach the luggage identification tag to a luggage item. Strap 28 is passed loosely through passage 14 and extends out of its opposite ends. Strap 28 is preferably constructed of nylon or a similar material having a low friction outside surface which facilitates rotation and longitudinal sliding movement of tube 12 on the strap. Strap 28 carries a buckle 30 on one end, and the opposite end of the strap can be pulled through the buckle to the extent desired, with the buckle securely locking the opposite end portion of the strap which it engages. Buckle 30 is large enough to prevent it from entering passage 14 and thus possibly inhibiting the free rotation or sliding movement of the unit on the strap.

In use, identification information such as the name and address of the owner of the luggage item is entered on label 16, and the adhesive side of the label is then applied to the inside tube 12. Tube 12 with label 16 applied thereto is then inserted into the outer transparent tube 20. Band 22 and rings 24 are applied to tube 20, as previously indicated. The nylon strap 28 is extended through passage 14, and connection of the unit to a luggage item such as a suitcase 32 (FIG. 4) is accomplished by looping the strap through the suitcase handle 34 or preferably through the hardware which serves to attach the handle to the case. The strap 28 easily fits through the handle bracket hardware due to its narrow width compared to the broader and weaker leather straps used in the past on luggage tags. The free end of strap 28 is then passed through buckle 30 and pulled until the strap has the desired length or loop size. The construction of buckle 30 is such that the strap cannot be backed out of it once it has been pulled through the buckle. The end portion of strap 28 projecting beyond buckle 30 is preferably clipped off, and its sharp corners may be filed.

Strap 28 is short enough to prevent the identification tag from hanging down below the case 32 when same is placed on its side on a conveyor or other automated baggage handling equipment. The restricted length of strap 28, together with the extension of the strap through the inside tube 12 to thus support the unit from both ends, prevents the identification tag from hanging down below the bottom of the case, thereby substantially eliminating the possibility of snagging. Consequently, unlike flat identification tags, the identification tag 10 does not catch or snag on other baggage items, rollers, diverter arms or other components of the baggage handling equipment. It is preferred that strap 28 be looped through the hardware supports which normally attach handle 34 to case 32, since the handle itself hangs away from the case.

Even if the identification tag should encounter an obstruction, its cylindrical shape gives it a curvature which prevents snagging. Additionally, tube 12 is able to freely rotate on strap 20 and to slide longitudinally thereon in order to avoid catching on obstructions. The strap itself can slide relative to the handle 34 or other portion of the case to which it is looped.

The three dimensional shape of the identification tag prevents complete exposure of all of the identification information 18 from any one vantage point. Thus, the shape of the device is sufficient by itself to prevent burglars from glance reading the address of a departing traveler. Also, the opaque band 22 hides approximately half of the identification information to further deter potential burglars. In order to read the complete address entered on label 16, it is necessary to slide band 22 back and forth between the opposite ends of the unit, and burglars are unlikely to do this since it requires that they physically handle the identification tag.

It is thus apparent that the present invention provides an improved identification tag which does not hang far enough away from the case to become snagged on rollers and other conveying equipment, and which prevents the identification information from being quickly read at a glance. The compact, tubular shape of the unit permits it to be supported from both ends and thus prevents it from flapping around conspicuously as occurs with flat identification tags.

Figure 5:
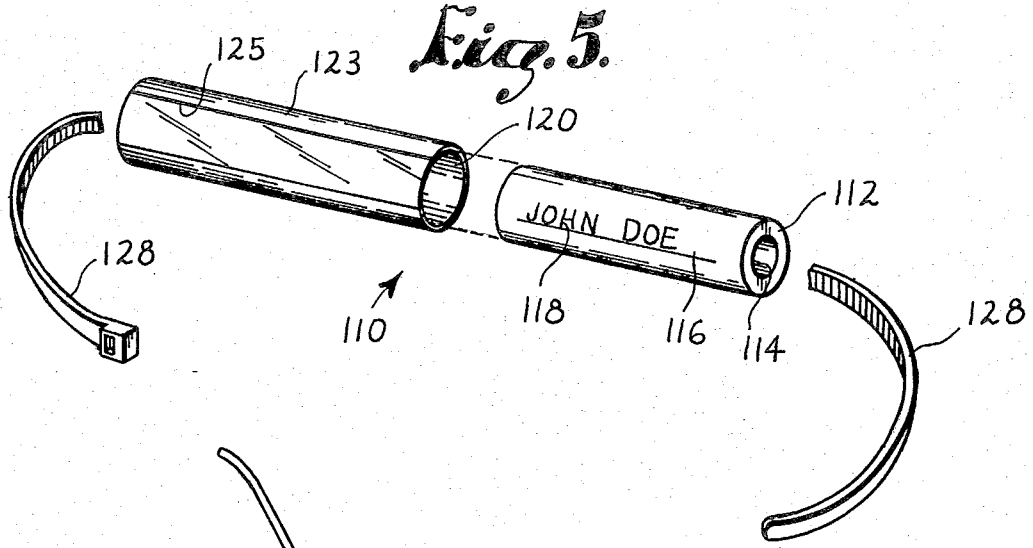
FIG. 5 is an exploded perspective view of a luggage identification tage constructed according to a second embodiment of the invention, with the central portion of the connection strap broken away.
Figure 6:
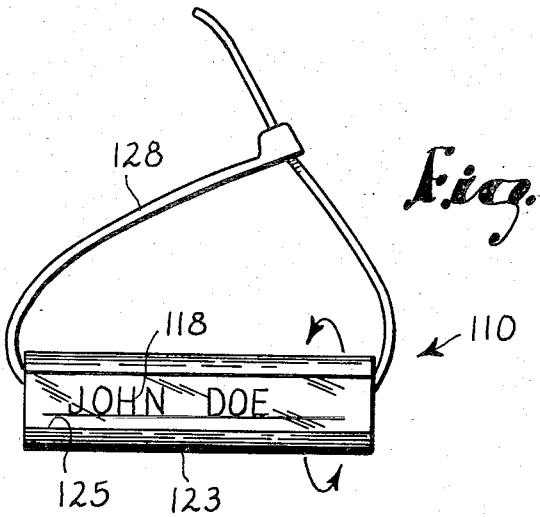
FIG. 6 is an elevational view of the luggage identification tag shown in FIG. 5.
Figure 7:
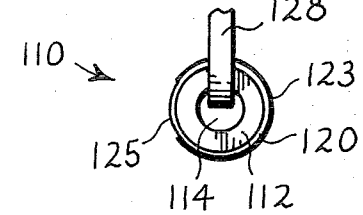
FIG. 7 is an end elevational view of the luggage identification tag shown in FIGS. 5 and 6.

Referring now to FIGS. 5–7, a luggage identification tag constructed in accordance with a second embodiment of the invention is generally identified by numeral 110. The identification tag 110 is similar to tag 10 for the most part. It includes a rigid tube 112, an address label 116, a transparent outer tube 120 and an elongate strap 128 which are identical to the tube 12, label 16, tube 20 and strap 28 described previously in connection with the first form of the invention. However, the identification tag 110 does not include the rings 24 or a band like the band 22. Instead, tag 110 includes an opaque band or cover 123 which adheres to the outside surface of tube 120 and has the same length as tube 120. Cover 123 does not extend completely around tube 120 but rather has its edges spaced apart to provide a narrow window 125 which extends the length of the unit and is only wide enough to expose, at any one time, a single line of the address information 118 located on the address label 116. The cover 123 includes an adhesive side from which the paper backing is stripped during manufacture prior to application of the cover to tube 120. The adhesive is an acrylic adhesive or an equally strong bonding agent. Cover 123 is an opaque plastic film which covers approximately 80% of the surface of tube 120 and is bonded thereto firmly enough to resist peeling off of the tube in normal use.

The luggage identification tag 110 shown in FIGS. 5–7 is used in the same manner as the tag 10 described previously, and it has the same advantages. Since only a single line of the identification information 118 is visible through the window 125, glance reading of the entire address label 116 is impossible and the identification information is effectively hidden from burglars. Authorized personnel can read the entire address by rotating tube 120 on the inside tube 112 in a manner to expose the address line by line through the window 125.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. An An identification tag for a luggage item, comprising:

a substantially tubular member having open opposite ends and presenting a continuous passage extending longitudinally therethrough between the opposite ends of said tubular member;

a label connected with said tubular member, said label being adapted to have identification information entered thereon;

an elongate flexible strap extending loosely through said passage of the tubular member and said opposite open ends, said strap having portions externally of said passage and adapted for attachment to the luggage item to attach said tubular member and label thereof with both ends of the tubular member supported by the strap while permitting said tubular member to move longitudinally on said strap and to rotate about the axis thereof; and a tubular band sleeved on said tubular member for movement thereon, said band being arranged to cover at least part of the identification information on said label at all positions of the band and to expose the identification information part by part as the band is moved on the tubular member.

2. The invention of claim 1, wherein said tubular member presents a generally cylindrical outside surface.

3. The invention to claim 1, wherein:

said tubular member is formed of a rigid material and presents a substantially cylindrical outside surface; and said label is sized to substantially cover said cylindrical outside surface of the tubular member with the identification information on the label extending around the tubular member.

4. The invention of claim 3, including a transparent tube applied to the outside surface of said tubular member in covering relation to the label.

5. The invention of claim 4, including a pair of rings on the exterior of said tube adjacent opposite ends thereof, said rings preventing said band from sliding off the ends of said tube.

6. The invention of claim 1, wherein said band is opaque and has a length dimension less than half the length dimension of the tubular member, said band being supported on said tubular member for sliding movement axially thereon.

7. The invention of claim 4, wherein said band is opaque and has a length dimension less than half the length dimension of the tubular member, said band being supported on said tubular member for sliding movement axially thereon.

8. The invention of claim 1, wherein said band is rotatable on said tubular member and has a transparent window portion of lesser area than is occupied by the identification information on said label, the remainder of said band being opaque to cover the identification information other than information with which said window is aligned.

* * * * *